US012781967B2

(12) United States Patent
Flaherty et al.

(10) Patent No.: US 12,781,967 B2
(45) Date of Patent: Nov. 3, 2026

(54) ARTIFICIAL LOG ASSEMBLY

(71) Applicant: Warming Trends, LLC, Englewood, CO (US)

(72) Inventors: Voni D. Flaherty, Greenwood Village, CO (US); Timothy S. Flaherty, Greenwood Village, CO (US); Kevin F. O'Connor, Parker, CO (US); Timothy Allons, Jr., Highlands Ranch, CO (US)

(73) Assignee: Warming Trends, LLC, Englewood, CO (US)

( * ) Notice: Subject to any disclaimer, the term of this patent is extended or adjusted under 35 U.S.C. 154(b) by 354 days.

(21) Appl. No.: 18/568,937

(22) PCT Filed: Jun. 17, 2021

(86) PCT No.: PCT/US2021/037779

§ 371 (c)(1),
(2) Date: Dec. 11, 2023

(87) PCT Pub. No.: WO2022/265638

PCT Pub. Date: Dec. 22, 2022

(65) Prior Publication Data

US 2024/0280269 A1 Aug. 22, 2024

(51) Int. Cl.
*F24C 3/00* (2006.01)

(52) U.S. Cl.
CPC ..... *F24C 3/006* (2013.01)

(58) Field of Classification Search
CPC ..... F24C 3/006
(Continued)

(56) References Cited

U.S. PATENT DOCUMENTS 613,015 A 10/1898 Monroe
663,811 A * 12/1900 Dudgeon ..... F24C 3/006 D23/343

(Continued)

FOREIGN PATENT DOCUMENTS

EP 3739266 A1 11/2020
GB 2182431 A 5/1987

OTHER PUBLICATIONS

Rocky Mountain Iron Logs photo, Jan. 26, 2013, Facebook, site visited Jan. 10, 2023: https://www.facebook.com/RockyMountainIronLogs/photos/pb.100048520495816.-2207520000./332164933559626/?type+3 (Year 2013).

(Continued)

*Primary Examiner* — Vivek K Shirsat
(74) *Attorney, Agent, or Firm* — Brooks Kushman P.C.

(57) ABSTRACT

An artificial log assembly includes an artificial log and a fuel supply. The artificial log is a non-flammable material. The artificial log has an outer wall defining a main portion rounded about and elongated along an axis and a branch portion extending from the main portion transverse to the main portion. The artificial log has a cavity extending along the main portion and from the main portion into the branch portion. Slits extend through the outer wall to the cavity. A fuel supply is in the cavity. The fuel supply includes a main pipe elongated along the axis in the cavity along the main portion and a branch pipe extending from the main pipe in the cavity along the branch portion. Fuel outlets are along the main pipe and are spaced along the axis. At least one of the fuel outlets extends from the branch pipe.

28 Claims, 9 Drawing Sheets

(58) Field of Classification Search
USPC ..... 126/500–555
See application file for complete search history.

(56) References Cited

U.S. PATENT DOCUMENTS

| | | | |
|---|---|---|---|
| 948,561 | A | 2/1910 | Hansen |
| 1,239,346 | A | 9/1917 | Brown |
| 1,286,108 | A | 11/1918 | Richards |
| 1,827,941 | A | 10/1931 | Henry |
| 2,084,566 | A | 6/1937 | Warfield |
| 2,302,796 | A | 11/1942 | Oyster |
| 2,516,282 | A | 7/1950 | Wilton |
| 2,644,515 | A | 7/1953 | Lampert |
| 2,762,362 | A | 9/1956 | Nielsen |
| 3,113,611 | A | 12/1963 | Dupler |
| 3,187,740 | A | 6/1965 | Jones |
| 3,334,820 | A | 8/1967 | Flynn |
| D215,440 | S | 10/1969 | Jones |
| 3,688,760 | A | 9/1972 | Rudin |
| 4,061,133 | A | 12/1977 | Swain |
| 4,418,456 | A | 12/1983 | Riehl |
| 4,582,478 | A | 4/1986 | Hilker |
| 4,875,464 | A | 10/1989 | Shimek et al. |
| 4,890,601 | A | 1/1990 | Potter |
| 4,971,031 | A | 11/1990 | Richardson |
| 4,976,253 | A | 12/1990 | Beal |
| 5,000,162 | A | 3/1991 | Shimek et al. |
| 5,069,200 | A | 12/1991 | Thow et al. |
| 5,081,981 | A | 1/1992 | Beal |
| 5,092,313 | A | 3/1992 | Blackburn |
| 5,571,008 | A | 11/1996 | Richardson |
| 5,655,513 | A | 8/1997 | Whitfield |
| D387,854 | S | 12/1997 | Newman |
| D400,243 | S | 10/1998 | Newman |
| 5,901,697 | A | 5/1999 | Oliver, Jr. et al. |
| 5,918,592 | A | 7/1999 | Kazubski et al. |
| 5,927,270 | A | 7/1999 | McDonald |
| 6,048,195 | A | 4/2000 | Shimek et al. |
| 6,070,559 | A | 6/2000 | Schlesch |
| 6,269,809 | B1 | 8/2001 | Fleming |
| 6,354,831 | B1 | 3/2002 | Wilk, Jr. et al. |
| 6,383,421 | B1 | 5/2002 | Phipps |
| 6,390,808 | B1 | 5/2002 | Cakebread |
| 6,428,313 | B1 | 8/2002 | Rodgers |
| 6,602,068 | B2 | 8/2003 | Atemboski et al. |
| 6,916,174 | B2 | 7/2005 | O'Donnell |
| 8,033,822 | B2 | 10/2011 | Junkins |
| 8,033,833 | B1 | 10/2011 | Lai |
| D726,583 | S | 4/2015 | Thomason |
| D745,651 | S | 12/2015 | Fu |
| 9,625,147 | B2 | 4/2017 | Kato |
| 2002/0132798 | A1 | 9/2002 | O'Donnell et al. |
| 2004/0058288 | A1 | 3/2004 | Lyons et al. |
| 2004/0089289 | A1 | 5/2004 | Tingley |
| 2006/0037603 | A1 | 2/2006 | Hoffman |
| 2006/0101681 | A1 | 5/2006 | Hess |
| 2010/0043282 | A1 | 2/2010 | Fischer |
| 2011/0048412 | A1 | 3/2011 | Kato et al. |
| 2011/0214342 | A1 | 9/2011 | Burgi |
| 2015/0068079 | A1 | 3/2015 | O'Neill |
| 2020/0240629 | A1* | 7/2020 | Gross ..... F23D 14/48 |
| 2020/0363066 | A1 | 11/2020 | Zhou |
| 2020/0378607 | A1 | 12/2020 | Zhou |
| 2021/0190321 | A1 | 6/2021 | Flaherty |

OTHER PUBLICATIONS

Steel Logs Forged for the Fireplace, May 24, 2019, YouTube, site visited Jan. 10, 2023: https://www.youtube.com/watch?v=J4vixmctZ3g (Year: 2019).

Montana Fire Pits photo, Sep. 27, 2019, Facebook, site visited Jan. 10, 2023: https://www.facebook.com/montanafirepits/photos/pb.100031770897047 .-2207520000./2321549568097009/?type=3 (Year: 2019).

Non-Final Office Action mailed Jan. 19, 2023 in related U.S. Appl. No. 29/717,675 (24 pages).

Extended European Search Report for Application No. EP20154333.7 mailed Sep. 2, 2020.

Extended European Search Report for Application No. EP21946219.9 mailed Jun. 13, 2024.

International Search Report and Written Opinion for PCT/US2021/037779 mailed Sep. 24, 2021 (10 pages).

* cited by examiner

ARTIFICIAL LOG ASSEMBLY

CROSS-REFERENCE TO RELATED APPLICATIONS

This application is a national stage of, and claims priority to, Patent Cooperation Treaty Application No. PCT/US2021/037779, filed on Jun. 17, 2021, which is hereby incorporated by reference in its entirety.

BACKGROUND

Artificial log assemblies can be used as alternatives to wood-burning fires. Artificial log assemblies are formed of non-flammable materials and a fuel, e.g., natural gas or liquid propane, is ignited to simulate burning wood.

Artificial log assemblies include an outer shell that attempts to simulate the appearance of a wooden log. Fuel is supplied to the outer shell such that, when ignited, the fuel burns to appear as though the artificial log is on fire. There remains an opportunity to improve the effectiveness of artificial log assemblies.

DETAILED DESCRIPTION

Figure 1:
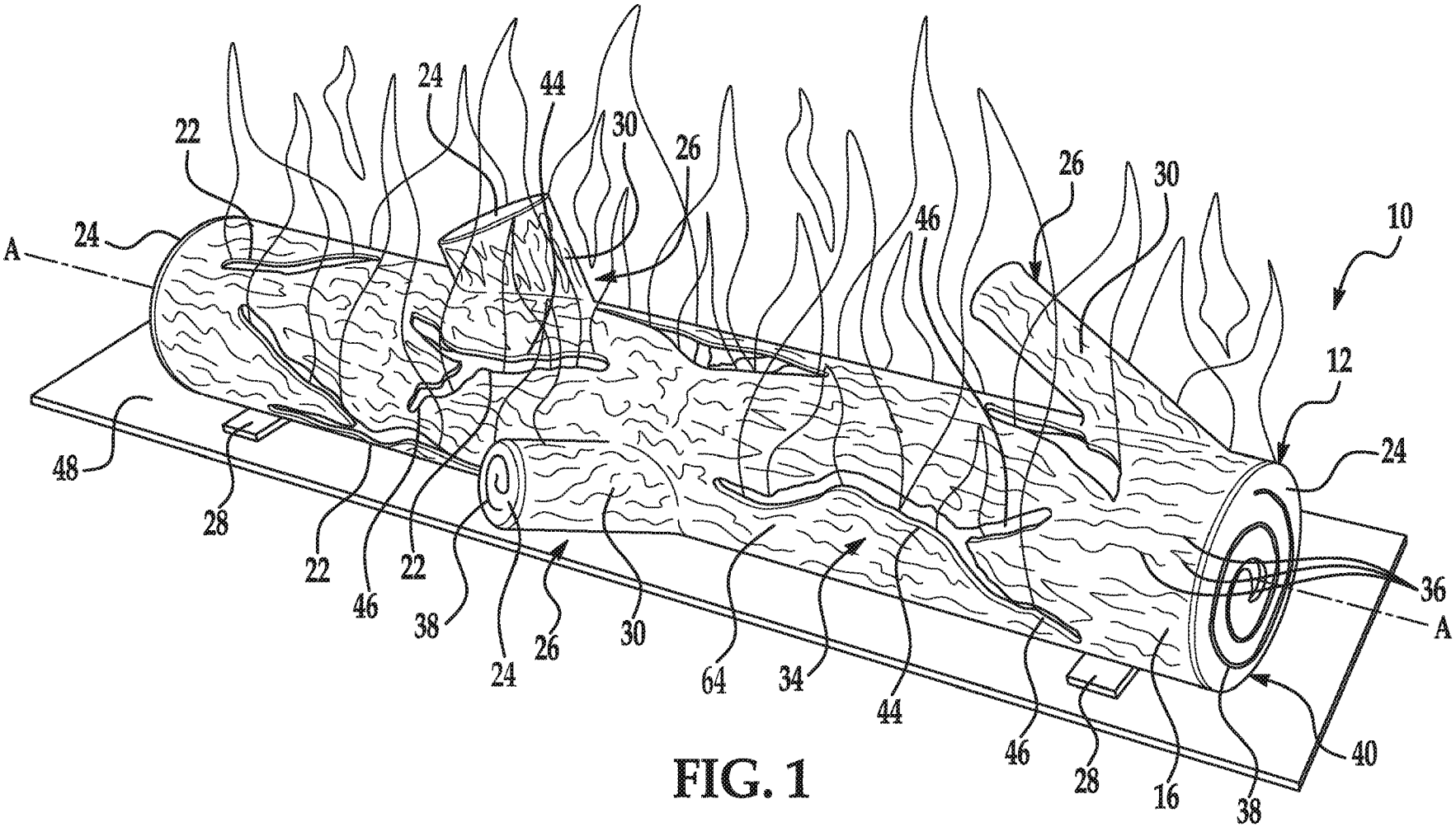
FIG. 1 is a perspective view of one example of an artificial log assembly in use with flames.

With reference to the Figures, wherein like numerals indicate like parts throughout the several views, an assembly 10, i.e., an artificial log burner assembly, is generally shown. One example of the assembly 10 is shown in FIGS. 1-6 and another example of the assembly 10 is shown in FIGS. 7-11. The assembly 10 includes an artificial log 12 and a fuel supply 14. The artificial log 12, for example, has an outer wall 16. The outer wall 16 includes a main portion 62 that may be substantially cylindrical. The main portion 62 is elongated along an axis A. The artificial log 12 has a cavity 18 inside the outer wall 16. The fuel supply 14 is in the cavity 18. The fuel supply 14, for example, has a plurality of fuel outlets 20. The fuel outlets 20, for example, are spaced from each other along the axis A. The outer wall 16, for example, includes slits 22 through the outer wall 16 to the cavity 18. For example, at least some of the slits 22 are spaced from each other along the axis A and are spaced from each other circumferentially about the axis A.

As an example, such as the example shown in FIGS. 7-11, the outer wall 16 defines a main portion 62 rounded about and elongated along the axis A and a branch portion 64 extending from the main portion 62 transverse to the main portion 62. In such an example, the cavity 18 extends along the main portion 62 and from the main portion 62 into the branch portion 64. The artificial log 12 has slits 22 extending through the outer wall 16 to the cavity 18. At least one of the slits 22 is on the main portion 62 and at least one of the slits 22 is on the branch portion 64. The fuel supply 14 includes a main pipe 66 elongated along the axis A in the cavity 18 along the main portion 62 and a branch pipe 68 extending from the main pipe 66 in the cavity 18 along the branch portion 64. At least one of the fuel outlets 20 is on the branch pipe 68.

Figure 7:
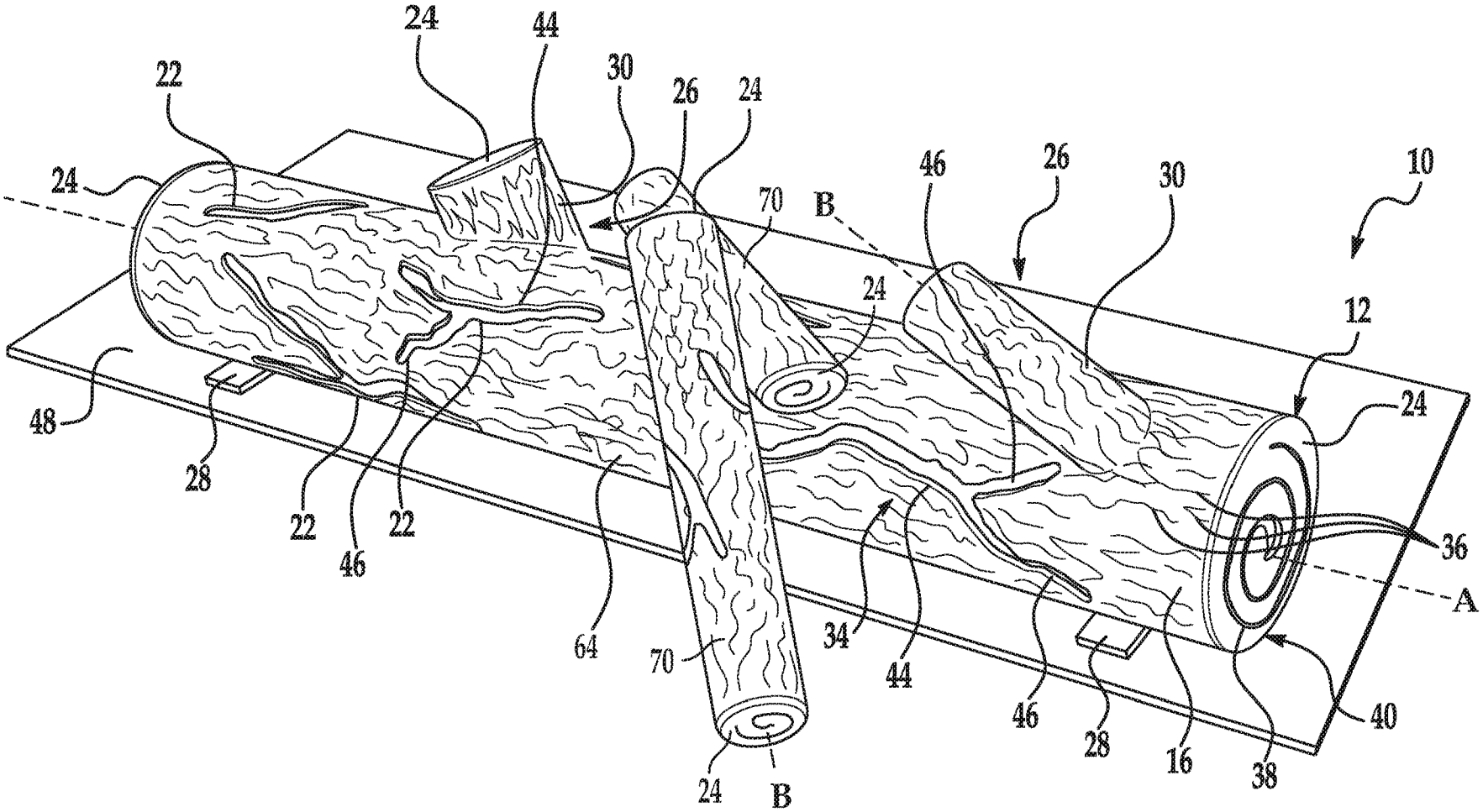
FIG. 7 is a perspective view of another example of the artificial log assembly.

With reference to FIGS. 1 and 7, the artificial log 12 has the dimensions and appearance of one or more wood logs, i.e., wood of a cut tree, as described further below. Since the fuel supply 14 is in the cavity 18 and the slits 22 extend through the outer wall 16, the flames in the cavity 18 are visible through the slits 22. Specifically, in some examples, the dancing of the flames in the cavity 18 and shadows in the cavity 18 are visible through the slits 22 because the fuel supply 14 is closer to the axis A than to the outer wall 16. In addition, at least some of the flames may extend from the cavity 18 through the slits 22, i.e., the flames extend externally from the slits 22. In combination, this gives the appearance of a burning log or a stack/pile of burning logs.

Figure 9:
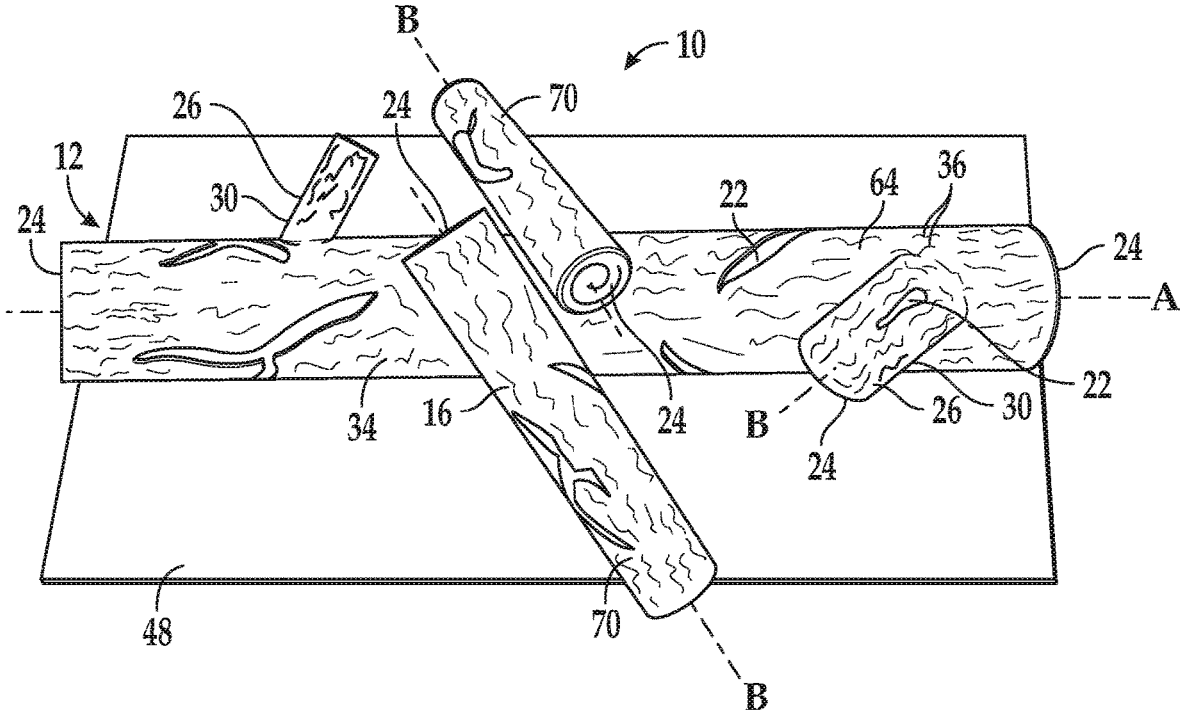
FIG. 9 is a top view of the artificial log assembly of FIG. 7.
Figure 10:
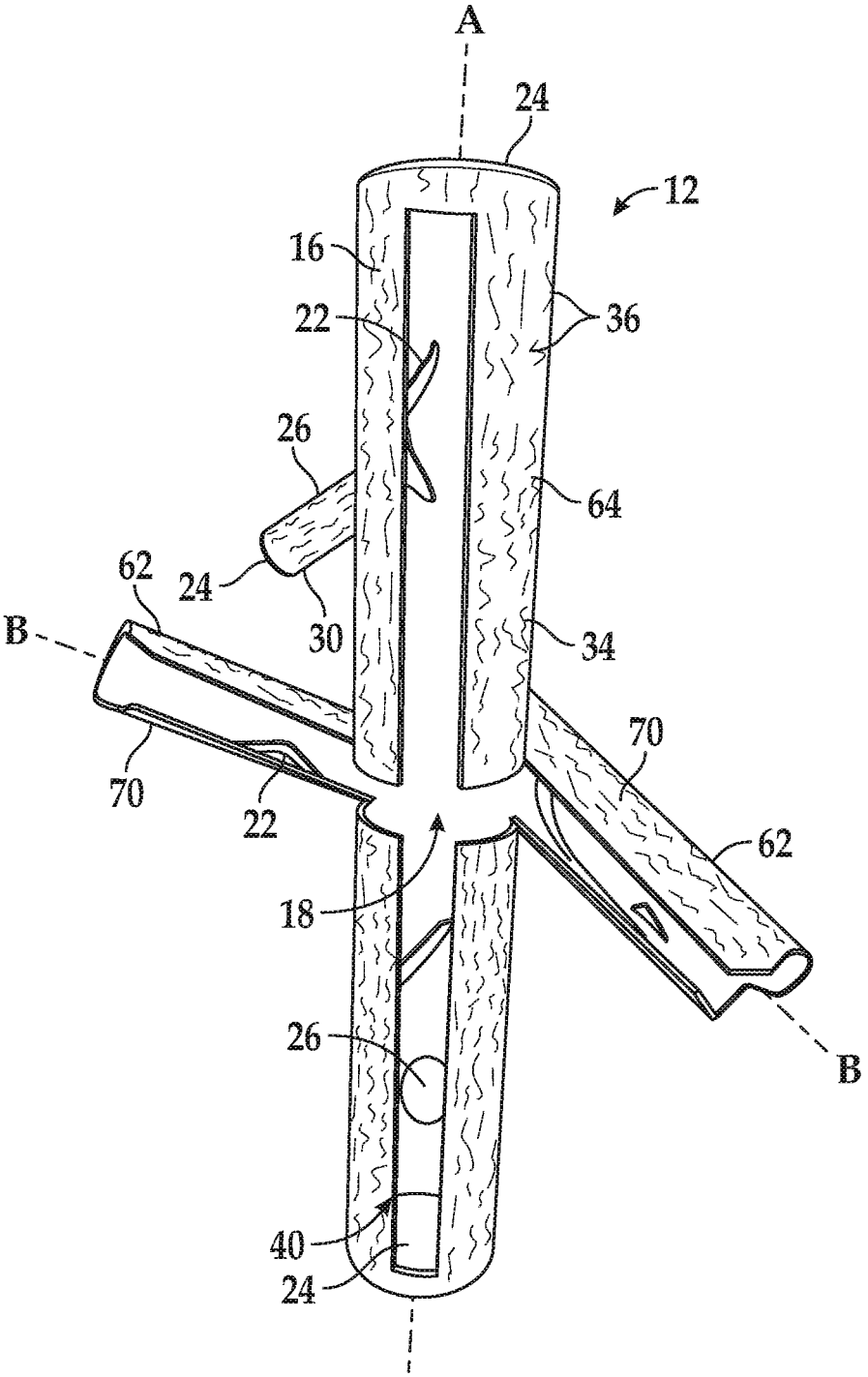
FIG. 10 is a bottom view of the artificial log of FIG. 7.
Figure 11:
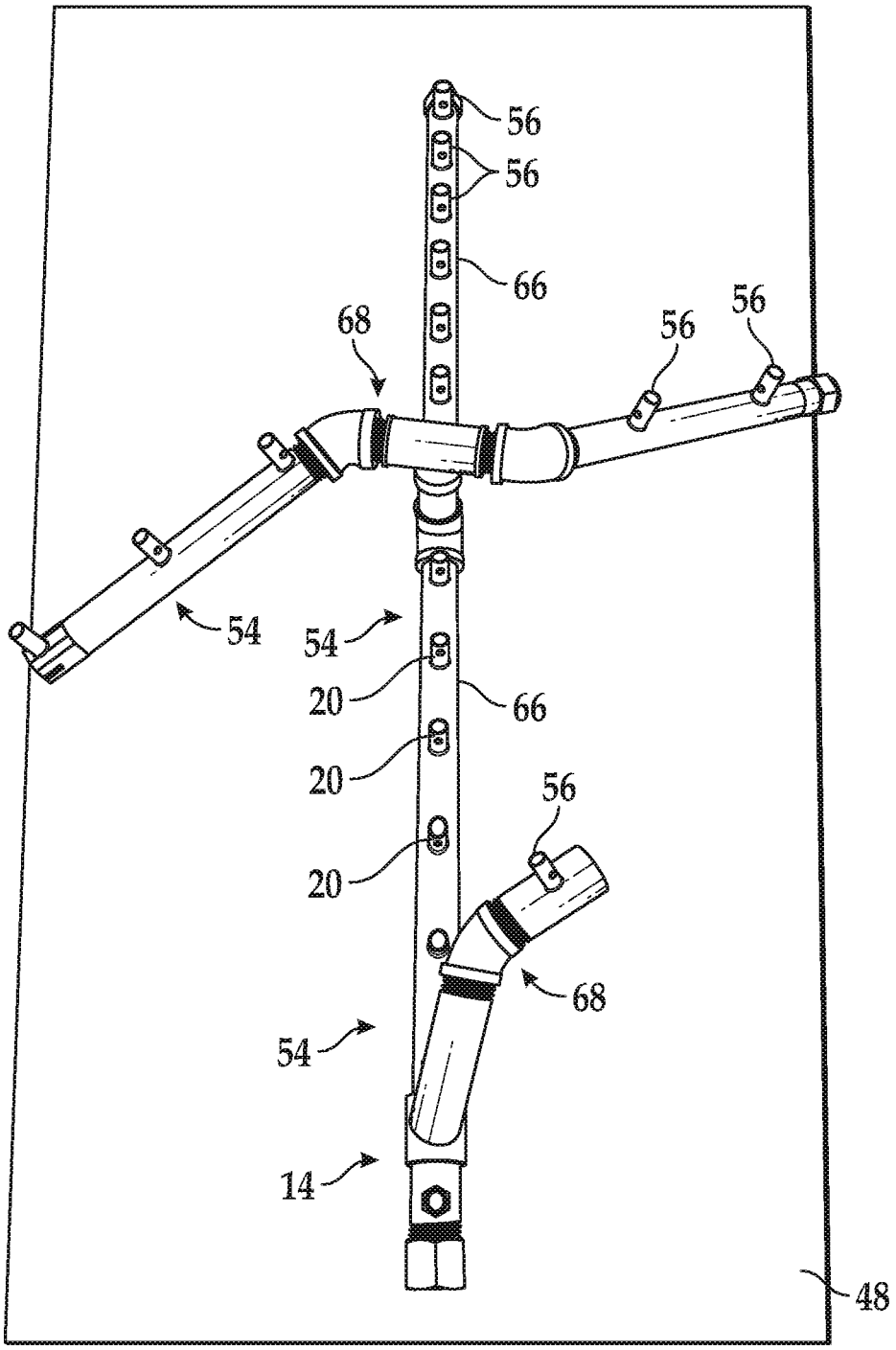
FIG. 11 is a top view of a portion of the artificial log assembly with the artificial log removed to show the fuel supply.

With reference to FIGS. 1 and 7, the artificial log 12 includes a main portion 62 that is elongated along the axis A. The main portion 62 may have the appearance of the central trunk of an elongated wood log. With continued reference to FIGS. 1 and 7, the artificial log 12 may include branch portions 64 that extend transverse from the main portion 62. The branch portion(s) 64 branch from the main portion 62 as described below. In other words, the branch portion 64 extends from the main portion 62 along an axis not parallel to the axis A of the main portion. As an example, as shown in FIGS. 1 and 7, the branch portion 64 may be a limb 26 extending transversely from the main portion 62. The limb 26 has the appearance of the base of a cut tree limb extending from the main portion 62. As another example, as shown in FIG. 7, the branch portion 64 may be another log 70 extending transverse to the main portion 62. The other log 70 has the appearance of another elongated wood log leaning against and/or stacked on the main portion 62. The other log 70 may be longer than, shorter than, or the same length as the main portion 62 and have a larger diameter, smaller diameter, or the same diameter as the main portion 62. The example in Figure includes the main portion 62, two additional logs 70, and two limbs 26. FIGS. 9 and 10 include the two additional logs 70 as an example as well as another example configuration of the limbs 26.

Figure 2:
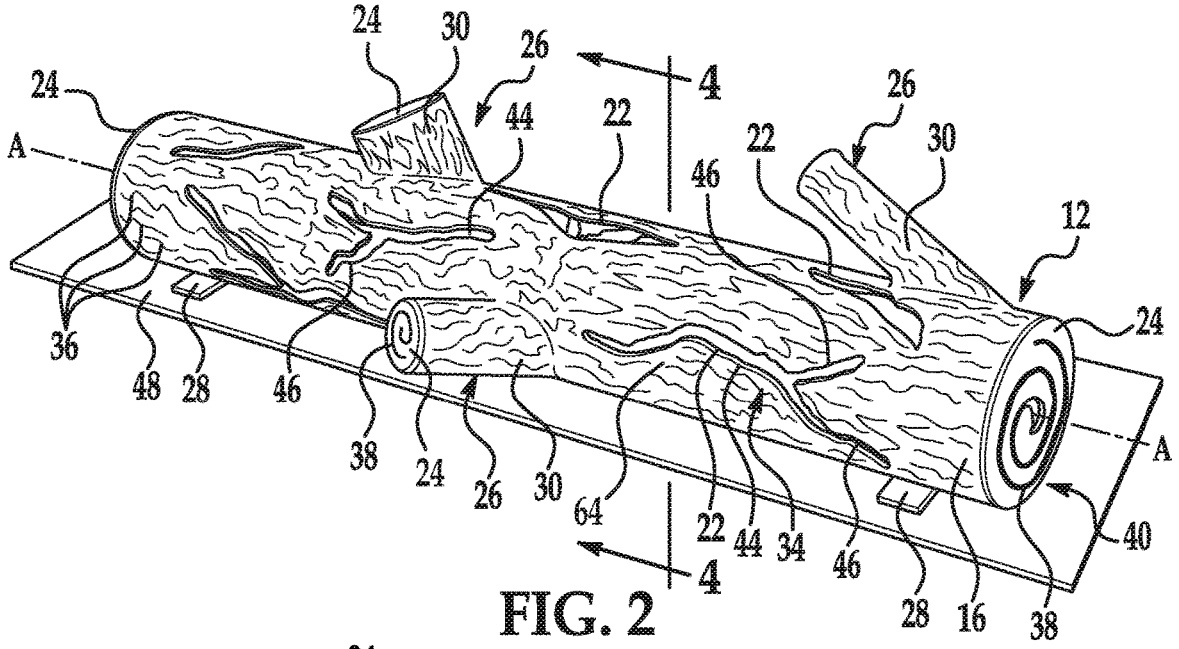
FIG. 2 is a perspective view of the artificial log assembly of FIG. 1 when not supplied with fuel.
Figure 3:
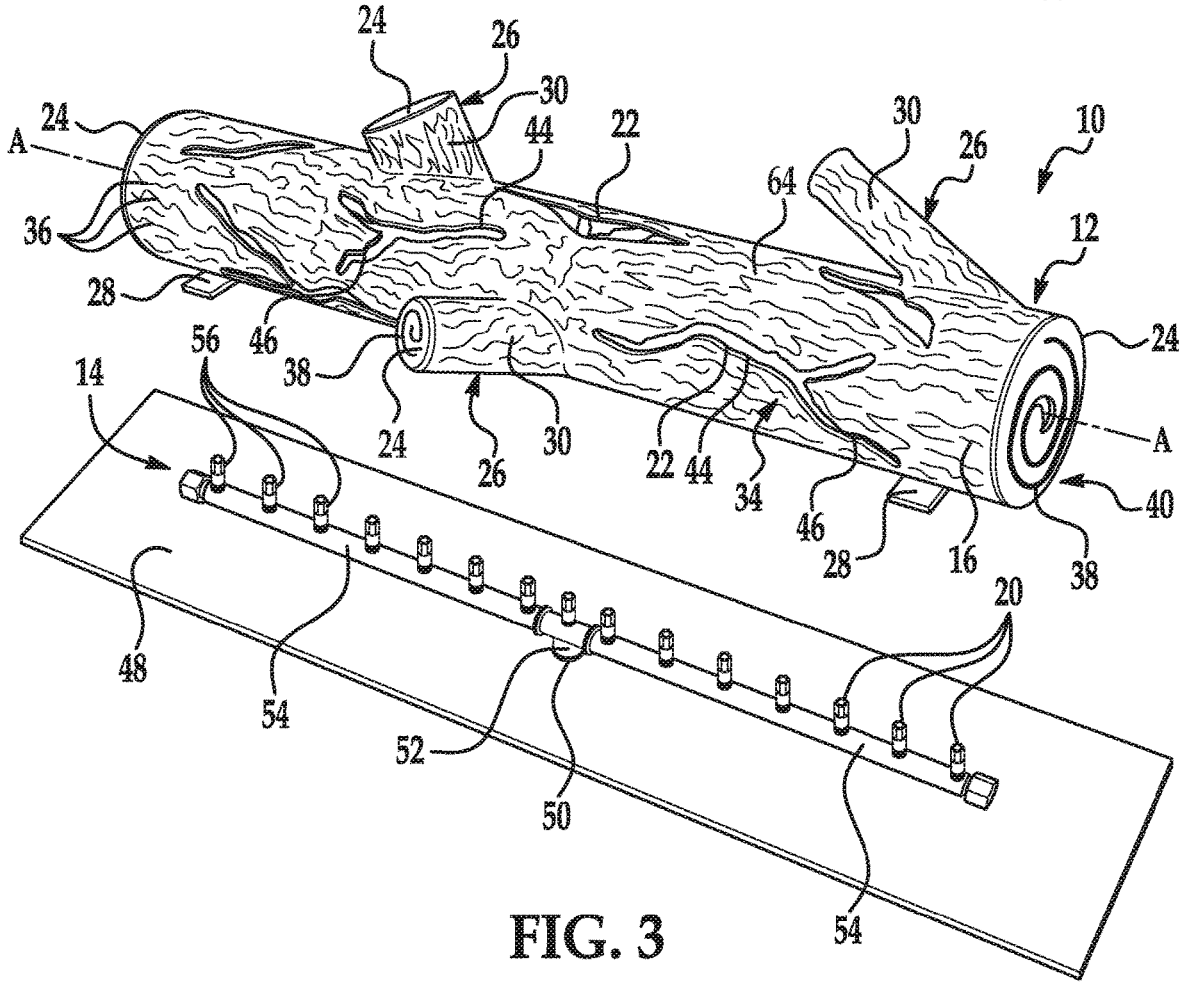
FIG. 3 is a partially exploded view of the log assembly of FIG. 1 including an artificial log, a fuel supply, and a base.

With reference to FIGS. 1-3, the artificial log 12 includes the outer wall 16 that has the cavity 18. The outer wall 16 defines the main portion 62 and the outer wall 16 may define ends 24 (e.g., end plates), limbs 26, feet 28, and/or additional logs 70. In the example shown in FIGS. 1-6, the artificial log 12 includes one main portion 62 with three limbs 26 extending transverse to the main portion 62. Specifically, the outer wall 16 defines the main portion 62 and the three limbs 26. In the example shown in FIG. 7, the artificial log 12 includes a main portion 62, two limbs 26, and two additional logs 70. Specifically, the outer wall 16 of the artificial log 12 define the main portion 62, the limbs 26, and the additional logs 70.

The artificial log 12 may be unitary, i.e., one piece with the components of the artificial log 12 fixed to each other and inseparable without destruction. An example of unitary is welding. For example, some or all of the main portion 62, the branch portions 64, the ends 24, and/or the feet 28 may be welded together (with "welded" being a structural description, not a description of the process of welding). In such an example, the outer wall 16 of the main portion 62 may be welded to the outer wall 16 of the branch portion(s) 64. As another example of unitary, some or all of the components may be integrally formed (with "integrally formed" being a structural description, not a description of the process of forming). Examples of being integrally formed includes casting (e.g., die casting, sand casting, pressure casting), machining a blank, additive manufacturing, etc. In examples in which the main portion 62, the branch portion(s) 64, and the ends 24 are unitary, the feet 28 may be unitary (e.g., welded, integrally formed, etc.) to the main portion 62 or may be fixed to the main portion 62 in any other suitable manner, e.g., with fasteners. In the examples shown in the Figures, the main portion 62, the branch portion(s) 64, the ends 24, and the feet 28 are unitary. Specifically, the outer wall 16 and bases 30 of the limbs 26 are integrally formed by casting, the ends and the feet 28 are welded to the main portion 62, and ends 24 of the limbs 26 are welded to the bases 30, respectively, of the limb 26. In the example shown in FIG. 7, the outer wall 16 of the other logs 70 are unitary with, e.g., welded together with, the outer wall 16 of the main portion 62 of the artificial log 12. In examples including other logs 70, the other logs 70 may be welded to the main portion 62 at holes in the main portion 62 and the other log 70 where the cavity 18 extends from the main portion 62 to the other log 70.

The artificial log 12 is a non-flammable material. As an example, the artificial log 12 may be metal. For example, the artificial log 12 is steel. The main portion 64, the ends 24, the limbs 26, and the feet 28 (and the other logs 70 in FIG. 7) may be the same type of material, e.g., steel. In examples in which the artificial log 12 is metal, e.g., steel, the metal is heated by the fuel supply 14 when the fuel supply is lit and the metal radiates heat outwardly.

Figure 4:
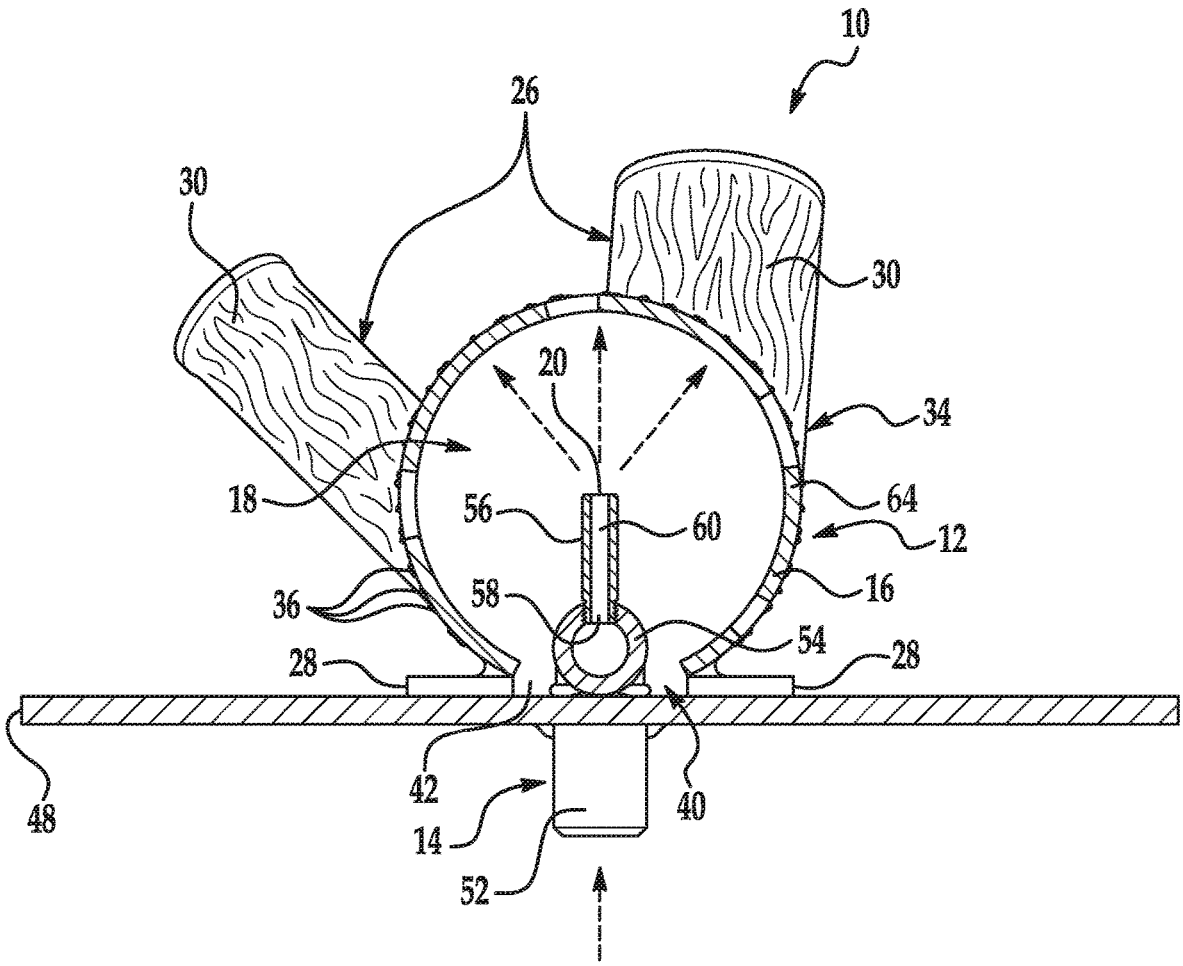
FIG. 4 is a cross-sectional view of the artificial log assembly along line 4 in FIG. 2.

With reference to FIG. 4, the outer wall 16 of the main portion 62 is rounded about and elongated along the axis A. Specifically, the outer wall 16 of the main portion 62 is rounded, e.g., circular, oval etc., in cross-section about the axis A. The outer wall 16 of the main portion 62 is longer along the axis A than the diameter of the outer wall 16 of the main portion 62. As an example, the outer wall 16 of the main portion 62 is substantially cylindrical about the axis A. Specifically, the outer wall 16 is a hollow cylinder, i.e., the artificial log 12 has the cavity 18 inside the outer wall 16. In the example shown in FIG. 7, the outer wall 16 of the main portion 62 and the outer wall 16 of the branch portion 64 may be substantially cylindrical. In such an example the outer walls 16 are hollow cylinders with the cavity 18 extending through the main portion 62 and the branch portions 64. The outer wall 16 (specifically an outer surface 34 and/or an interior surface) may deviate from a perfect hollow, cylindrical shape to provide the appearance of a substantially cylindrical log with some deviation allowed for natural appearance (divots, dips, surface features 36, etc.), manufacturing limitations, manufacturing artifacts (e.g., weld lines, part lines, etc.), etc.

The cavity 18 of the example of FIG. 1 may be substantially cylindrical in the main portion 62. The cavity 18 may extend continuously from one end 24 to the other end 24 of the main portion 62. The limbs 26 may be hollow, in which case, the cavity in the limbs 26 are open to the cavity 18 of the outer wall 16. The cavity of the example of FIG. 7 may extend continuously through the main portion 62, the branch portions 64, and the limbs 26.

The dimensions of the outer wall 16 provide dancing flames and shadows in the cavity 18 and provide for the visibility of the dancing flames and shadows through the slits 22. The dimensions of the outer wall 16 also provide access for the flames to extend out of the cavity 18 through the slits 22 to the exterior of the artificial log 12.

The outer wall 16 is relatively thin and elongated. Specifically, the outer wall 16 is elongated along the axis A. In the example shown in FIG. 7, the outer wall 16 of the main portion 62 is elongated along the axis A. With reference to FIG. 4, the outer wall 16 may have a wall thickness WT less than 1/10 (10%) the outer diameter D of the outer wall 16 of the main portion 62. For example, the outer diameter D of the outer wall 16 of the main portion 62 may be 5 inches (12.7 cm) and the wall thickness WT may be 1/8 inch (0.32 cm). The outer wall 16 may have a substantially uniform wall thickness WT and a substantially uniform outer diameter D. Specifically, the wall thickness WT and outer diameter D may deviate from perfect uniformity to provide the appearance of a substantially cylindrical log with some deviation allowed for natural appearance (divots, dips, surface features 36, etc.), manufacturing limitations, manufacturing artifacts (e.g., weld lines, part lines, etc.), etc. The outer wall 16 of the artificial log 12 of FIG. 7 may have the same dimensions as shown in FIG. 4.

As set forth above, the outer wall 16 of the main portion 62 is elongated. The outer wall 16 has a length L and the outer diameter D of the outer wall 16 may be less than 1/4 of the length L of the outer wall 16. For example, the outer diameter D of the outer wall 16 may be 5 inches (12.7 cm) and the length L of the outer wall 16 may be 32 inches (81.3 cm).

The ends 24 are fixed to the outer wall 16, i.e., the ends 24 are end plates. For example, as set forth above, the ends 24 may be welded to the outer wall 16. The main portion 62 of the artificial log 12 may include two ends 24 are spaced from each other along the axis A. The ends 24 enclose the cavity 18 therebetween, i.e., the cavity 18 extends from one end 24 to the other end 24 and the ends 24 define the terminal boundaries of the cavity 18. The ends 24 may be identical to each other or different than each other. The branch portions 64 may include ends 24. In the example shown in the Figures, the limbs 26 include ends 24 fixed to the base 30 of the limbs 26. In some examples shown in the Figures, the other logs 70 include ends 24 and in other examples the other logs 70 do not include ends 24, i.e., are open at one or both ends.

The limbs 26 extend transversely from the outer wall 16 of the main portion 62. The limbs 26 have the appearance of branches extending away from the outer wall 16 of the main portion 62. The base 30 of the limbs 26 are substantially cylindrical. The bases 30 of the limbs 26 are fixed to the outer wall 16 of the artificial log 12, as described above. As set forth above, the limbs 26 may be hollow, in which case, the cavity extends from the main portion 62 into the limbs 26. Each limb 26 may include an end 24 fixed to the outer wall 16 of the limb 26.

The outer surface 34 of the artificial log 12 may have the appearance of a log (i.e., a cut portion of a tree trunk or branch) or a stack or pile of logs. For example, the outer surface 34 of the outer wall 16 may have surface features 36 having the appearance of tree bark. In addition, the outer surface of the base 30 of the limbs 26 may have a matching surface feature 36 having the appearance of bark. The surface feature 36 may include, for example, ridges, as shown in the Figures. The ridges extend outwardly from the rest of the outer surface 34. The ridges may be metal, e.g., the same type of metal as the outer wall 16. As another example in addition to or in the alternative to the ridges, the surface feature 36 may include grooves, i.e., the groves extend inward relative to the rest of the outer surface 34. The surface features 36 are elongated, i.e., significantly wider than long. In any event, the majority of the surface features 36, e.g., the ridges or the grooves, are substantially elongated along the axis A. In other words, most of the surface features 36 have a major component of elongation along the axis A to simulate the appearance of bark. Surface features 36 that are substantially elongated along the axis A may have curves, angles, etc., to simulate bark, i.e., the surface features 36 that are substantially elongated along the axis A are not necessarily straight along the axis A from one end to the other end of the surface feature 36. At least some of the surface features 36 are elongated along the axis A and some of the surface features 36 may be elongated transverse to the axis A, and in any event, more of the surface features 36 are elongated along the axis A to simulate bark.

As another example of the appearance of the artificial log 12 as a log, the ends 24 of the artificial log 12 and/or the ends 24 of the limbs 26 and/or the ends of the other logs 70 may have a smooth outer surface 34, i.e., lacking the surface features 36 on the outer surface 34 of the outer wall 16 and/or on the bases 30 limbs 26, and may have spiral voids 38 in the smooth surfaces. The smooth surfaces simulate cut wood and the spiral voids 38 simulate growth rings of the tree. The spiral voids 38 on the ends 24 of the artificial log 12 and/or the end 24 of the limbs 26 may extend through the end 24 to the cavity 18 such that the cavity 18 is visible through the spiral voids 38. In such an example, the spiral void 38 provides visibility of the dancing flames in the cavity 18.

Figure 5:
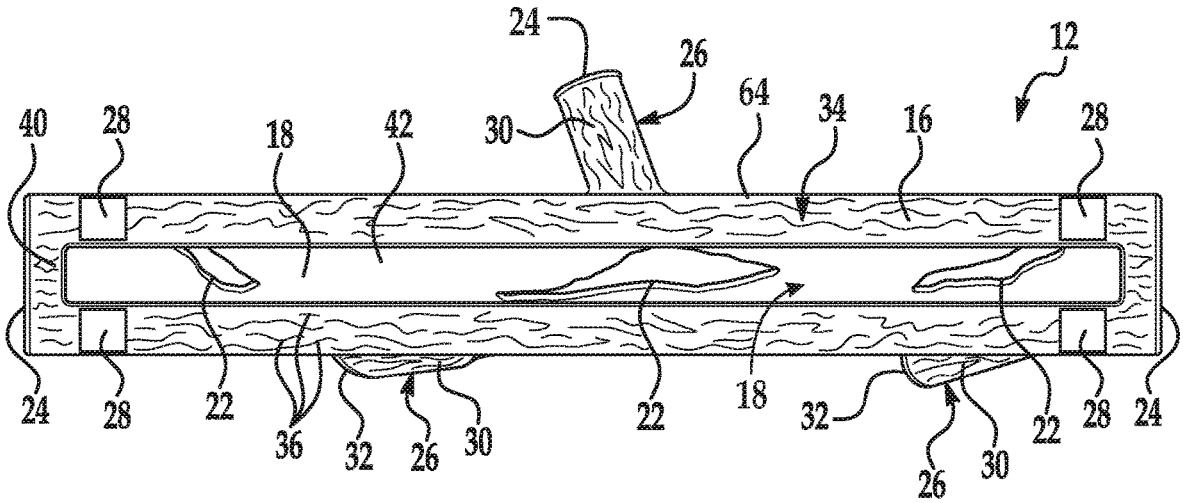
FIG. 5 is a bottom view of the artificial log of FIG. 1.
Figure 6:
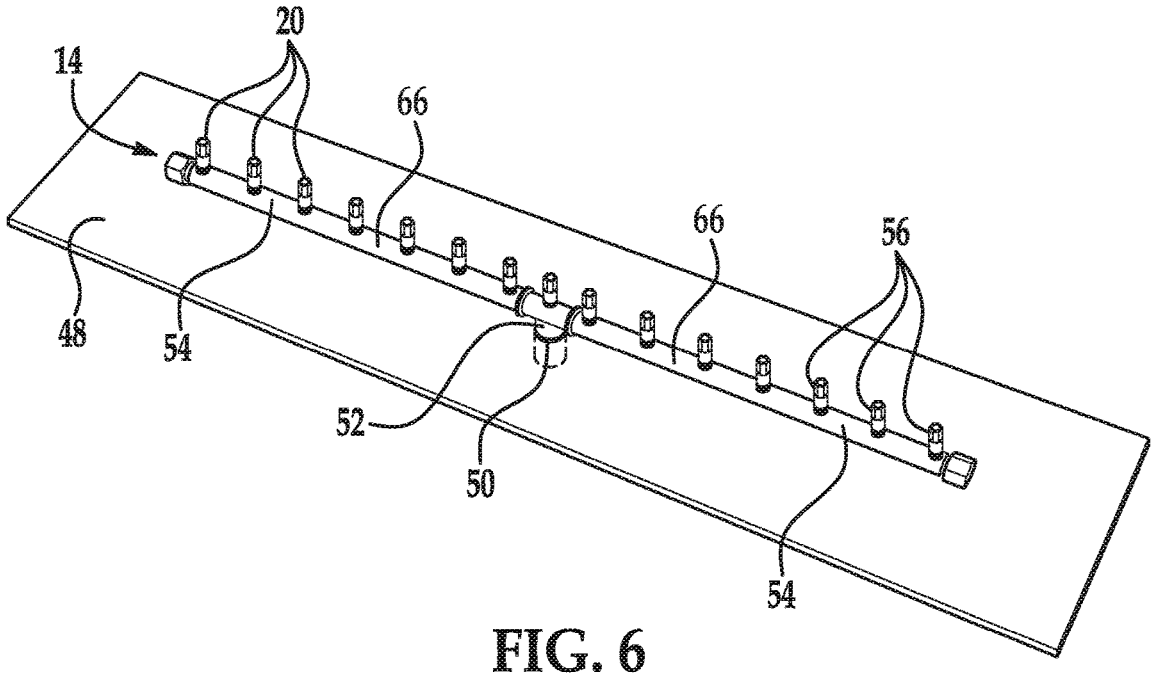
FIG. 6 is a perspective view of the fuel supply and the base of FIG. 1.

With reference to FIGS. 4-5 and 10, the artificial log 12 includes a bottom 40. Specifically, the outer wall 16 has the bottom 40. The bottom 40 may be curved, i.e., following the arc of the rest of the outer wall 16, or may be flat. The bottom 40 has an elongated opening 42 receiving the fuel supply 14. In the example shown in FIG. 10, the elongated opening 42 extends through the main portion 62 and the other logs 70.

With reference to FIGS. 1 and 7, the slits 22 extend through the outer wall 16 to the cavity 18. In other words, the cavity 18 is visible through the slits 22. Specifically, one or more slits 22 are on the main portion 62 of the artificial log 12 and one or more slits 22 may be on the branch portion 64 of the artificial log 12. The examples shown in the Figures show various examples of location and number of the slits 22 on both the main portion 64 and the branch portion 64 merely by way of example; one or more slits 22 may be on the main portion 62 and one or more slits 22 may be on the branch portion 64 and any suitable combination thereof.

The slits 22 are spaced from each other to give an appearance of random arrangement. At least some of the slits 22 are spaced from each other along the axis A and spaced from each other circumferentially about the axis A.

The slits 22 have the appearance of cracks in a log. Each slit 22 may have one or more portions that are elongated along the axis A and/or one or more portions elongated circumferentially about the axis A. For example, one or more of the slits 22 may have an axial portion 44 and a diverging portion 46, as shown in the Figures. The slits 22, e.g., the axial portion 44 and/or the diverging portion 46, are elongated, i.e., are significantly wider than long, as described further below. The axial portion 44 on the main portion 62 of the artificial log 12 is elongated along the axis A, i.e., a major component of the elongation is along the axis A. The diverging portion 46 extends transversely from the axial portion 44. The diverging portion 46 may be elongated circumferentially about the axis A, i.e., a major component of elongation is circumferential about the axis A. The slits 22, e.g., the axial portion 44 and/or the diverging portion 46 may have curves, angles, etc., to simulate a crack in a log, i.e., the slits 22 are not necessarily straight from one end to the other end of the slit.

As set forth above, the flames in the cavity 18 are visible through the slits 22. As described further below, the dimensions of the slits 22 provide dancing flames and shadows in the cavity 18 and provide for the visibility of the dancing flames and shadows. The dimensions of the slits 22 also provide access for the flames to extend out of the cavity 18 through the slits 22 to the exterior of the artificial log 12. In addition, the dimensions of the slits 22 relative to each other and relative to the dimensions of the outer wall 16 generally conceal the fuel supply 14. Specifically, the dancing flames and shadows in the cavity 18 and the flames extending through the slits 22 are generated, in part, by the dimensions of the slits 22 and the slits 22 generally prevent visibility of the fuel supply 14 through the slits 22.

The slits 22 each have a length LS and a width WS. The length LS is the longest dimension along the outer wall 16 and the width WS is perpendicular to the length LS. The slits 22 may have different lengths and/or different widths. The slits 22 have a thickness measured radially from the axis A, i.e., the thickness is the same as the wall thickness WT of the outer wall 16.

As set forth above, the dimensions of the slits 22 provide visibility of the flames and conceal the fuel supply 14. For example, the greatest width WS of each slit 22 may be less than 1/10 the circumference of the outer wall 16 of the main portion 62. As an example, the circumference of the outer wall 16 of the main portion 62 may be 15.75 inches (39.9 cm) and the greatest width WS of the slits 22 may be 0.5-1.0 inches (1.27-2.54 cm). The length LS of each slit 22 may be less than ½ (50%) the length L of the outer wall 16 of the main portion 62. As an example, the length L of the outer wall 16 of the main portion 62 may be 32 inches (81.3 cm) and the length LS of each slit 22 may be 5-9 inches (12.7-22.9 cm). As an example, the length LS of each slit 22 along the axis A, i.e., the length LS of the axial portion 44, may be less than ½ (50%) the length L of the outer wall 16 of the main portion 62.

With reference to FIGS. 1-3 and 5-6, the assembly 10 may include a base 48. As one example, the base 48 is a plate. In such an example, the base 48 may be metal, e.g., aluminum, stainless steel, etc. The base 48 may include a hole 50. As set forth further below, the fuel supply 14 extends through the hole 50. The base 48 supports the artificial log 12. The bottom 40 and/or feet 28 of the artificial log 12 may rest on the base 48. In other examples, the base 48 may be a pan, grating, or other suitable non-flammable surface.

As set forth above, the fuel supply 14 is in the cavity 18. The fuel supply 14 may include an inlet 52 and at least one pipe 54. In some examples, the fuel supply 14 includes a plurality of jets 56. The inlet 52, the pipe 54, and the jets 56 may be of any suitable material, e.g., brass, black steel, etc.

The fuel supply 14 may be designed to supply gaseous fuel, e.g., natural gas, liquid propane, etc. The fuel supply 14 supplies gaseous fuel, which is lit so that the fuel supply 14 fuels flames in the artificial log 12.

The inlet 52 may extend through the base 48. For example, as set forth above, the inlet 52 may extend through the hole 50. Specifically, in such an example, the inlet 52 extends from below the base 48, through the hole 50, to above the base 48. The inlet 52 supplies fuel to the pipe 54. The inlet 52 may be in the cavity 18 when the artificial log 12 is on the base 48. In examples in which the inlet 52 is in the cavity 18, the hole 50 is aligned with the cavity 18 when the artificial log 12 is on the base 48.

At least one pipe 54 extends from the inlet 52 in the cavity 18. Specifically, the pipe 54 may be elongated along the axis A, i.e., parallel with the axis A and on or spaced from the axis A. The pipe 54 may be spaced from the base 48. The pipe 54 delivers fuel from the inlet 52 to fuel outlets 20, e.g., through the jets 56. The pipe 54 may be connected to the inlet 52 in any suitable fashion, e.g., the inlet 52 may have a female thread and the pipe 54 may have a male thread threadedly engaged with the female thread.

The fuel supply 14 may include more than one pipe 54. In the example shown in the Figures, the fuel supply 14 includes two pipes 54 each extending from the inlet 52. In such an example, as shown in the Figures, the hole and the inlet 52 may be substantially centered on the along the length L of the outer wall 16. The hole, for example, may be centered on the base 48. The pipes 54 may extend in opposite directions along the axis A, i.e., parallel to the axis A and on or spaced from the axis A. In such an example, the inlet 52 may be a T-coupling. The pipes 54 may be of identical length. In other examples, the inlet 52 may be between pipes 54 of varying length, at the end of a single pipe 54, at one end of a pipe 54 that is connected to other pipes, etc.

The pipe(s) 54 may be in a straight configuration, as shown in FIG. 3. For example, in FIG. 3, two pipes 54 are axially aligned and elongated along the axis A. As another example, pipes 54 may extend transversely to each other. For example, in FIG. 8, the pipes 54 of the fuel supply 14 include two main pipes 66 and two branch pipes 68. In that example, the main pipes 66 are elongated along the axis A and the branch pipes 68 extend transverse to the main pipes 66.

In the example shown in FIGS. 7-11, the pipes 54 may include any suitable number of branch pipes 68. The branch pipes 68 extend from the main pipe 66 in the cavity 18 along branch portions 64 of the artificial log 12. Specifically, the branch pipe 68 follows the branch portion 64 of the artificial log 12. The branch pipe 68 extends from the main pipe 66 toward the end 24 of the branch portion 64. Specifically, the branch pipe 68 may extend more than halfway from the main pipe 66 to the end 24 of the branch portion 64.

Figure 8:
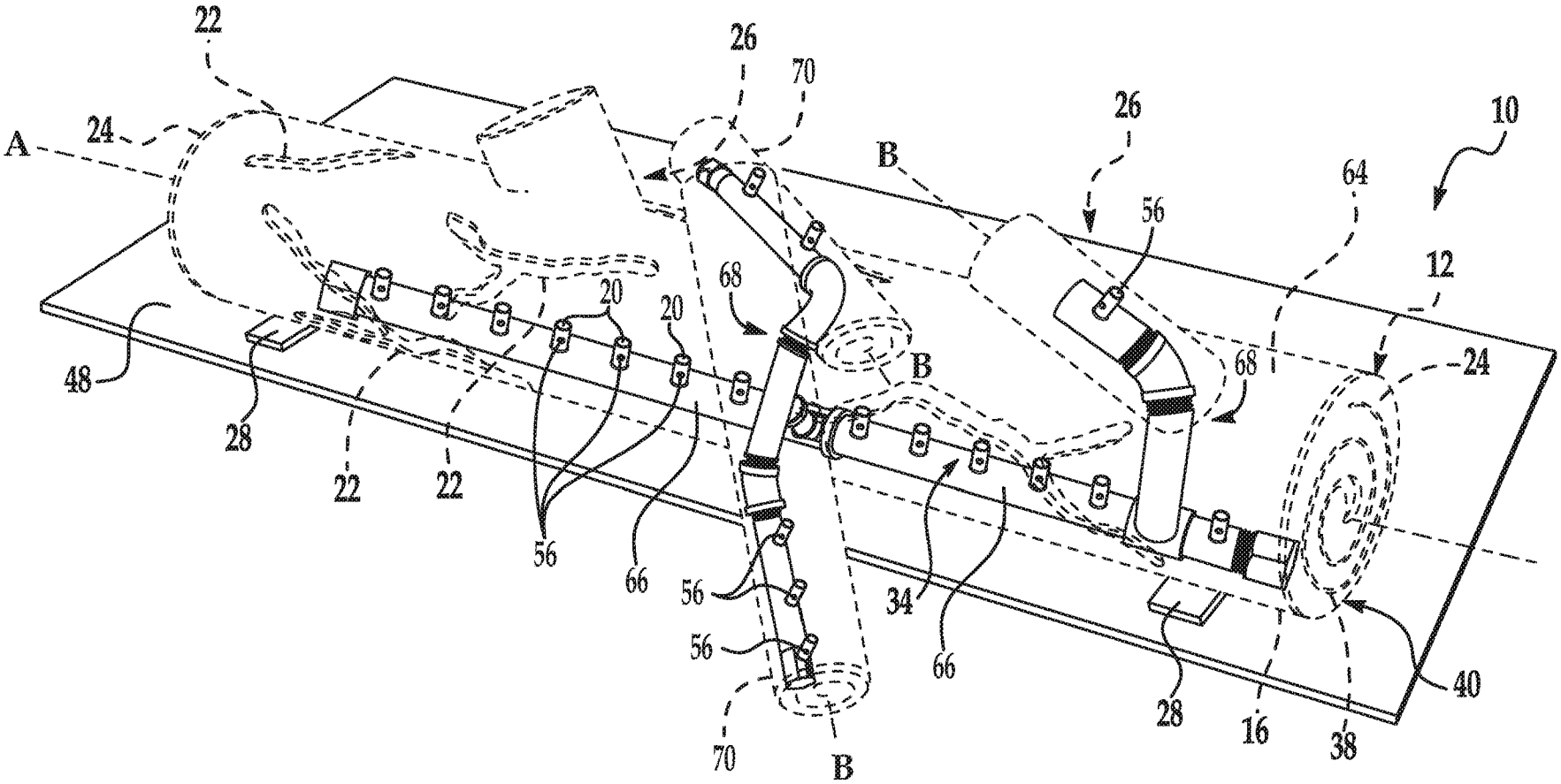
FIG. 8 is a perspective view of the artificial log assembly of FIG. 8 with the artificial log in broken lines to show the fuel supply in a cavity of the artificial log.

As set forth above, the cavity 18 extends from the main portion 62 into the branch portion 64. The main pipes 66 are in the cavity 18 in the main portion 62 and the branch pipes 68 extend from the main pipes 66 into the cavity 18 in the main portion 62. As set forth above, the main pipes 66 may be elongated along the axis A of the main portion 62. The branch pipes 68 extend transverse to the main pipes 66. Specifically, the branch pipe 68 may extend perpendicular to the main pipe 66 or at any suitable angle relative to the main pipe 66 to follow the branch portion 64 of the artificial log 12. The branch portion 64 may be elongated along an axis B, and at least a portion of the branch pipe 68 may be elongated along the axis B, as shown in FIG. 8. The axis B of the branch portion 64 of the artificial log 12 is not parallel (i.e., non-parallel) with the axis A and may be spaced from or transverse to the axis A.

In the example shown in FIG. 8, the branch pipes 68 may include multiple segments of pipe and may include connectors. For example, the branch pipe 68 that extends into the branch portions 64 in FIG. 5 includes two T's two elbows, and multiple sections of pipe.

The fuel supply 14 may include any suitable number of branch pipes 68 to extend into one or more of the branch portions 64 of the artificial log 12. In the example shown in FIG. 8, as an example, the fuel supply 14 includes one branch pipe 68 that extends into one limb 26 and another branch pipe 68 that extends into other logs 70. Specifically, in the example shown in FIG. 8, one of the branch pipes 68 extends into two other logs 70. In other examples, one branch pipe 68 may extend into a single other log 70, one branch pipes 68 may extend into multiple other logs 70, and/or multiple branch pipes 68 may extend into respective ones of a multitude of other logs 70.

As set forth above, the fuel supply 14 includes a plurality of fuel outlets 20 on the pipe 66, 68. As an example, the fuel supply 14 may include the jets 56 on the pipes 66, 68 that include the fuel outlets 20. In such an example, the jets 56 are on the pipes 66, 68 and, accordingly, the fuel outlets 20 are on the pipes 66, 68. In such an example, the jets 56 space the flame from the pipes 66, 68, as described further below. In other examples, the fuel outlets 20 may be orifices in the wall of the pipes 66, 68. The examples shown in FIGS. 1-6 and 7-11 include jets and it should be appreciated that the examples shown in FIGS. 1-6 and/or 7-11 may alternatively include the orifices described above and/or any other suitable type of fuel outlet 20.

In examples including jets 56, the jets 56 extend transversely from the pipe 54. For example, the jets 56 extend upwardly from the pipe 54. The jets 56 may be parallel to each other. The jets 56 are elongated from the pipe 54. Specifically, some of the jets 56 extend from the main pipe 66 in the cavity 18 of the main portion 62 of the artificial log 12. In examples in which the fuel supply 14 includes a branch pipe 68, at least one jet 56 extends from the branch pipe 68 in the cavity 18 of the branch portion 64 of the artificial log 12. In the example shown in FIG. 8, multiple jets 56 are on the branch portions 64.

In examples including jets 56, each jet 56 includes one of the fuel outlets 20, i.e., the fuel outlets 20 are on the jets 56. Each jet 56 includes an inlet end 58, the fuel outlet 20, and a chamber 60 extending from the inlet end 58 to the fuel outlet 20. Fuel is supplied from the pipe 54 into the inlet end 58, and from the inlet end 58 to the fuel outlet 20 through the chamber 60. The jet 56 may include an air orifice between the inlet end 58 and the fuel outlet 20 to intake air to aid in combustion. The jet 56 may be connected to the pipe 54 in any suitable fashion, e.g., the pipe 54 may have a female thread and the jet 56 may have a male thread at the inlet end 58 and threadedly engaged with the female thread.

The fuel outlets 20, e.g., on the jets 56, release fuel for combustion. The fuel outlets 20 are in the cavity 18. In examples including jets 56, at least a portion of each jet 56 including the fuel outlet 20 is in the cavity 18 such that the flame is in the cavity 18. Specifically, the fuel outlets 20 on the jets 56 are in the cavity 18. In the example shown in the Figures, the entire jet 56 is in the cavity 18. In examples including multiple fuel outlets 20 on the main pipe 66, the fuel outlets 20 on the main pipe 66 are spaced from each other along the axis A. Specifically, the fuel outlets 20 on the main pipe 66 may be spaced from each other in a line along the axis A, i.e., parallel to the axis A and on or spaced from the axis A. In examples including multiple fuel outlets 20 on the branch pipe 68, the fuel outlets 20 on the branch pipe 68 are spaced from each other along the axis B of the branch pipe 66. Specifically, the fuel outlets 20 on the branch pipe 66 may be spaced from each other in a line along the axis B, i.e., parallel to the axis B and on or spaced from the axis B.

The position of the fuel outlets 20 in the cavity 18 provide dancing flames and shadows in the cavity 18 and provide for the visibility of the dancing flames and shadows through the slits 22. The position of the fuel outlets 20 also provide for the flames to extend out of the cavity 18 through the slits 22 to the exterior of the artificial log 12.

The cavity 18 may be unfilled between the fuel outlets 20 and the outer wall 16. In other words, an air gap is between the fuel outlets 20 and the outer wall 16 and between the fuel outlets 20 and the slits 22.

The fuel outlets 20 may be closer to the axis A than to the outer wall 16. As an example, the fuel outlets 20 may be substantially on the axis A of the outer wall 16. As another example, the fuel outlets 20 may be spaced from the axis A between the axis A and the outer wall 16, e.g., vertically above the axis A. In other words, the outer wall 16 has a height vertically measured from the base 48, and the axis A is at the midpoint of the height. In such an example, the fuel outlets 20 are between the height and the axis A. Said differently, the fuel outlets 20 are less than halfway from the axis A to the outer wall 16.

The assembly 10 described above has the dimensions and appearance of one or more wood logs, i.e., a cut tree trunk or branch, that is on fire. For example, in the example in FIG. 1, the assembly has the appearance of one wood log including short cut limbs. In the example shown in FIG. 7, the assembly 10 has an appearance of two smaller logs stacked on a larger log. Alternatively, the assembly 10 may have the appearance of a variety of stacks or piles of logs.

The dimensions of features of the assembly 10, i.e., components of the artificial log 12 and/or the fuel supply 14, provide dancing of the flames inside the cavity 18 and shadows in the cavity 18. The dimensions also provide for visibility of the dancing flames and shadows in the cavity 18. The dimensions of features of the assembly 10 also provide for the flames to extend from the cavity 18 through the slits 22. Specifically, portions of at least some of the flames are contained by the interior surface of the outer wall 16, causing the flame to dance in the cavity 18 and causing shadows in the cavity 18, and portions of at least some of the flames extend through the slits 22, also leading to the dancing flames and shadows in the cavity 18. The dancing flames and shadows are visible through at least some of the slits 22. The position of the fuel outlets 20 and the spacing of the fuel outlets 20 along the axis A also contribute to the dancing flames and shadows in the cavity 18 as well as the extension of a portion of some of the flames through the cavity 18. In the example in FIGS. 7-11, the branch pipes 68 in the branch portion 64 of the artificial log 12 causes the flame to dance in the cavity of the branch portion 64, which is visible through the slits 22.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

The invention claimed is:

1. An artificial log assembly comprising:

an artificial log being a non-flammable material, the artificial log having an outer wall defining a main portion rounded about and elongated along an axis and a branch portion extending from the main portion transverse to the main portion;

the artificial log having a cavity inside the outer wall, the cavity extending along the main portion and from the main portion into the branch portion;

slits extending through the outer wall to the cavity, at least one of the slits being on the main portion and at least one of the slits being on the branch portion;

a fuel supply in the cavity;

the fuel supply including a main pipe elongated along the axis in the cavity along the main portion and a branch pipe extending from the main pipe in the cavity along the branch portion; and a plurality of the fuel outlets along the main pipe and being spaced along the axis; and at least one of the fuel outlets extending from the branch pipe; and the cavity being unfilled between the fuel outlets and the outer wall.

2. The artificial log assembly of claim 1, wherein the main portion is generally cylindrical including an outer wall and two ends and the branch portion is generally cylindrical with an outer wall and two ends, the outer wall of the branch portion abutting the outer wall of the main portion.

3. The artificial log assembly of claim 2, wherein the artificial log includes a bottom having an opening receiving the fuel supply.

4. The artificial log assembly of claim 3, wherein the opening extends through the main portion and the branch portion.

5. The artificial log assembly of claim 1, wherein the main portion is generally cylindrical including an outer wall and two ends and the branch portion is generally cylindrical with an outer wall, a base, and an end, the base of the branch portion abutting the outer wall of the main portion.

6. The artificial log assembly of claim 1, further comprising a jet extending transversely from the branch pipe, the jet including the fuel outlets spaced from the branch pipe.

7. The artificial log assembly of claim 1, wherein the fuel supply includes an inlet and two pipes, the inlet being substantially centered along a length of the outer wall, the two pipes being of identical length and extending from the inlet in opposite directions along the axis.

8. The artificial log assembly of claim 1, wherein at least some of the slits have at least an axial portion elongated along the axis.

9. The artificial log assembly of claim 8, wherein at least some of the slits have a diverging portion extending transversely from the axial portion.

10. The artificial log assembly of claim 1, wherein the outer wall has a substantially uniform wall thickness and the outer wall of the main portion includes a substantially uniform outer diameter, the wall thickness of the outer wall being less than 1/10 the outer diameter of the outer wall of the main portion.

11. The artificial log assembly of claim 1, wherein the outer wall of the main portion of the artificial log has a length along the axis and the slits on the main portion each have a length, the length of each slit being less than ½ the length of the outer wall of the main portion.

12. The artificial log assembly of claim 1, wherein the outer wall of the main portion of the artificial log has a length and an outer diameter, the outer diameter of the outer wall being less than ¼ of the length of the main portion.

13. The artificial log assembly of claim 1, wherein the outer wall of the main portion has a circumference and the slits on the main portion each have a length and a width, the greatest width of each slit being less than 1/10 the circumference of the outer wall of the main portion.

14. The artificial log assembly of claim 13, wherein the outer wall has a length along the axis and the slits each have a length along the axis, the length of each slit being less than ½ the length of the outer wall.

15. The artificial log assembly of claim 1, wherein the outer wall is metal.

16. The artificial log assembly of claim 1, wherein the outer surface includes surface features having the appearance of tree bark.

17. The assembly of claim 1, wherein the artificial log includes a bottom having an elongated opening receiving the fuel supply.

18. The artificial log assembly of claim 1, wherein the artificial log includes ends fixed to the outer wall of the main portion and spaced from each other along the axis enclosing the cavity therebetween.

19. The artificial log assembly as set forth in claim 1, further comprising a base supporting the artificial log above the base, the base having a hole, and the fuel supply extending through the hole from below the base to above the base.

20. The artificial log assembly as set forth in claim 1, wherein:

the main portion includes a bottom, the main pipe being between the bottom and the axis, and the fuel outlets being between the main pipe and the outer wall of the main portion.

21. The artificial log assembly as set forth in claim 20, wherein the fuel outlets are closer to the axis than to the outer wall.

22. The artificial log assembly as set forth in claim 20, wherein a portion of the pipe is at the bottom.

23. An artificial log assembly comprising:

an artificial log being a non-flammable material, the artificial log having an outer wall defining a main portion rounded about and elongated along an axis and a branch portion extending from the main portion transverse to the main portion;

the artificial log having a cavity inside the outer wall, the cavity extending along the main portion and from the main portion into the branch portion;

slits extending through the outer wall to the cavity, at least one of the slits being on the main portion and at least one of the slits being on the branch portion;

a fuel supply in the cavity;

the fuel supply including a main pipe elongated along the axis in the cavity along the main portion and a branch pipe extending from the main pipe in the cavity along the branch portion; and a plurality of the fuel outlets along the main pipe and being spaced along the axis;

at least one of the fuel outlets extending from the branch pipe; and the main portion includes a bottom, the main pipe being between the bottom and the axis, and the fuel outlets being between the main pipe and the outer wall of the main portion.

24. The artificial log assembly as set forth in claim 23, wherein the fuel outlets are closer to the axis than to the outer wall.

25. The artificial log assembly as set forth in claim 23, wherein a portion of the pipe is at the bottom.

26. The artificial log assembly of claim 23, wherein the outer wall is metal.

27. An artificial log assembly comprising:

an artificial log being a non-flammable material, the artificial log having an outer wall defining a main portion rounded about and elongated along an axis and a branch portion extending from the main portion transverse to the main portion;

the artificial log having a cavity inside the outer wall, the cavity extending along the main portion and from the main portion into the branch portion;

slits extending through the outer wall to the cavity, at least one of the slits being on the main portion and at least one of the slits being on the branch portion;

a fuel supply in the cavity;

the fuel supply including a main pipe elongated along the axis in the cavity along the main portion and a branch pipe extending from the main pipe in the cavity along the branch portion; and jets extending transversely from the branch pipe along the main pipe, the jets including fuel outlets spaced from the branch pipe;

at least one of the fuel outlets extending from the branch pipe.

28. The artificial log assembly of claim 27, wherein the outer wall is metal.

* * * * *